US006568923B2

(12) United States Patent
Ikuta

(10) Patent No.: US 6,568,923 B2
(45) Date of Patent: May 27, 2003

(54) FLUID SUCTION AND DISCHARGE APPARATUS

(76) Inventor: Kazumasa Ikuta, Green Corp. 301, 3-2, Horiguchi, Kanagawa-Ku, Yokohama (JP)

( * ) Notice: Subject to any disclaimer, the term of this patent is extended or adjusted under 35 U.S.C. 154(b) by 46 days.

(21) Appl. No.: 09/832,022

(22) Filed: Apr. 11, 2001

(65) Prior Publication Data

US 2002/0081223 A1 Jun. 27, 2002

(30) Foreign Application Priority Data

Dec. 21, 2000 (JP) ..... 2000/389001

(51) Int. Cl.[7] ..... F04B 7/00
(52) U.S. Cl. ..... 417/462; 417/517
(58) Field of Search ..... 417/535, 536, 417/517, 518, 519, 462, 502

(56) References Cited

U.S. PATENT DOCUMENTS 3,586,129 A * 6/1971 Cass ..... 184/7
6,179,583 B1 * 1/2001 Weston ..... 417/392

* cited by examiner

*Primary Examiner*—Charles G. Freay
*Assistant Examiner*—William H. Rodriguez
(74) *Attorney, Agent, or Firm*—Armstrong, Westerman & Hattori, LLP

(57) ABSTRACT

It is an object of the present invention to provide a fluid suction and discharge apparatus capable of continuously discharging fluid with a predetermined flow rate and pressure continuously sucking the fluid without substantially giving rise to pulsation.

This invention comprises an inner tube rotatably fitted in a fitting hole of the apparatus body, a cylinder slidably fitted into the inner tube, and a plurality of through-holes formed in the inner tube, wherein when the cylinder is reciprocated in association with rotation of the inner tube, and when one of the through-holes of the inner tube is communicated with a suction hole of the apparatus body, the other through-hole of the inner tube is communicated with a discharge hole of the apparatus body, and when fluid is sucked from a communication suction hole thus communicated, fluid is discharged from the discharge hole thus communicated.

11 Claims, 7 Drawing Sheets

FLUID SUCTION AND DISCHARGE APPARATUS

BACKGROUND OF THE INVENTION

1. Field of the Invention

The present invention relates to a fluid suction and discharge apparatus capable of being used as a multi-purpose pump as well as a compressor, and more specifically, to a fluid suction and discharge apparatus using a rotary type switching valve (a rotary valve) capable of continuously sucking and discharging fluid without substantially giving rise to pulsation.

2. Background of the Invention

In the past, in a vacuum pump for exhausting the apparatus to reduce pressure, when a piston is reciprocating, pressure occurs when pushing, but no pressure occurs when pulling, resulting in a disadvantage in that pulsation is severely produced.

Further, in a conventional high pressure pump used as a water supply pump for a boiler and the like, since a piston is used for a pump (a plunger pump), likewise resulting in a disadvantage in that outlet pressure will be pulsation. Since such a pulsation as described above causes a pointer of a pressure gage for measuring outlet pressure to swing up and down, under present conditions, breakage preventing means is mounted on the pressure gage.

SUMMARY OF THE INVENTION

It is an object of the present invention to provide a fluid suction and discharge apparatus capable of continuously discharging fluid with a predetermined flow rate and pressure continuously sucking the fluid without substantially giving rise to pulsation.

It is a further object of the present invention to provide a fluid suction and discharge apparatus capable of being used as a vacuum pump and a high pressure pump as well as a compressor.

For achieving the above-described objects, the apparatus of the present invention comprises an inner tube rotatably fitted in a fitting hole of the apparatus body, a cylinder slidably fitted into the inner tube, and a plurality of through-holes formed in the inner tube, wherein when the cylinder is reciprocated in association with rotation of the inner tube, and when one of the through-holes of the inner tube is communicated with a suction hole of the apparatus body, the other through-hole of the inner tube is communicated with a discharge hole of the apparatus body, and when fluid is sucked from a communication suction hole thus communicated, fluid is discharged from the discharge hole thus communicated.

The above-described apparatus body is not particularly limited as long as a fitting hole is provided, but generally, a block body having an outer tube or a fitting hole is used.

The above and other objects and advantages of the invention will become more apparent from the following description.

DETAILED DESCRIPTION OF THE PREFERRED EMBODIMENTS

The preferred embodiments of the present invention will be described hereinafter with reference to the drawings.

Figure 1:
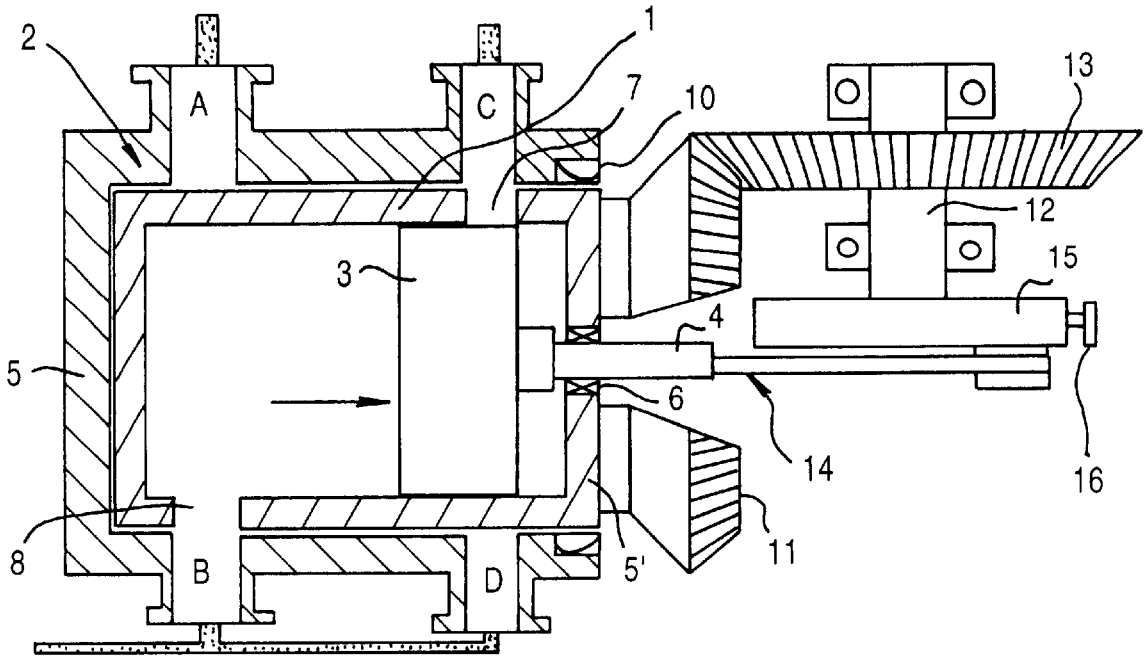
FIG. 1 is a sectional view showing an embodiment of the present invention.

FIG. 1 shows an embodiment of the present invention. An inner tube 1 is rotatably fitted over an outer tube 2 through a bearing 10. A cylinder 3 is slidably fitted in the inner tube 1, and a piston shaft 4 connected to the cylinder 3 is rotatably fitted into a fitting hole of a side wall 5' of the inner tube 1 through a ball bearing 6. The ball bearing 6 may be formed of high temperature resistant, high pressure and high speed metal.

The inner tube 1 is formed on both sides thereof with semicircular (180°) through-holes 7, 8 in the form of a slot in the rotational direction. Both the through-holes 7, 8 are formed adjacent to or close to both the side walls 5, 5' of the inner tube are positioned in the surfaces (parts rotated by 180°) opposite to each other and at the part away in the sliding direction of the piston. Accordingly, when one is communicated with a suction hole A (or C) of the upper outer tube, the other is communicated with a discharge hole D (or B) of the lower outer tube.

The outer tube 2 is formed with two suction holes A, C at the upper part, and with two discharge holes B, D opposite to the suction holes A, C at the lower part.

When the cylinder 3 is reciprocated in association with the rotation of the inner tube 1 and one through-hole 7 (or 8) is communicated with one suction hole C (or A) of the outer tube 2, the other through-hole 8 (or 7) is communicated with the discharge hole B (or D) of the outer tube 2; and when fluid is sucked from one communication hole, fluid is discharged from the other communication hole. In the above-described embodiment, the suction holes and the discharge holes of the outer tube are respectively formed in number of two (A and C, B and D). This is because when either through-hole 7 or 8 of the inner tube is communicated with the suction hole C (or A) of the outer tube, the other through-holes 7, 8 of the inner tube are communicated with the discharge hole B (or D) of the outer tube. The suction holes (A and C) and the discharge holes (B and D) may be communicated together, respectively.

A heat resistant and anti-abrasive depressed ring (not shown) is fitted in and mounted on the outer circumference of the cylinder 3. Accordingly, the cylinder 3 may be reciprocated at high speed under the high temperature.

Pressure and or flow rate discharged from the through-hole communicated is (are) detected, and rotational speed of the inner tube 1 and reciprocating speed of the cylinder 3 are controlled on the basis of the signal detected. One out of the pressure and flow rate of fluid may be detected and controlled, but preferably, both of them are detected to control the pressure of fluid discharged and the flow rate constant.

A first gear (a bevel gear) 11 is provided on the end of the inner tube 1, and the first gear 11 is meshed at right angle with a second gear (a bevel gear) secured to a rotational shaft 12 of a motor. A crank shaft 14 for reciprocating a piston shaft 4 is secured to a rotary body 15 secured to the rotational shaft 12 of the motor. Since the first gear 11 and the second gear 13 are the same in tooth number, when the inner tube rotates once, the piston shaft 4 reciprocates once.

The crankshaft 14 is secured to the rotary body 15, and the piston shaft 4 is reciprocated by the rotation of the rotary body 15. When the rotary body rotates once, the crankshaft 14 reciprocates once, and the inner tube 1 rotates once.

The fixed position of the crankshaft 14 is changed between the center of the rotary body 15 and the outer circle direction by a stroke adjusting screw 16 whereby the suction and discharge quantities of fluid can be changed. The suction and discharge quantities can be also changed even by changing the rotational speed of the motor.

Figure 4:
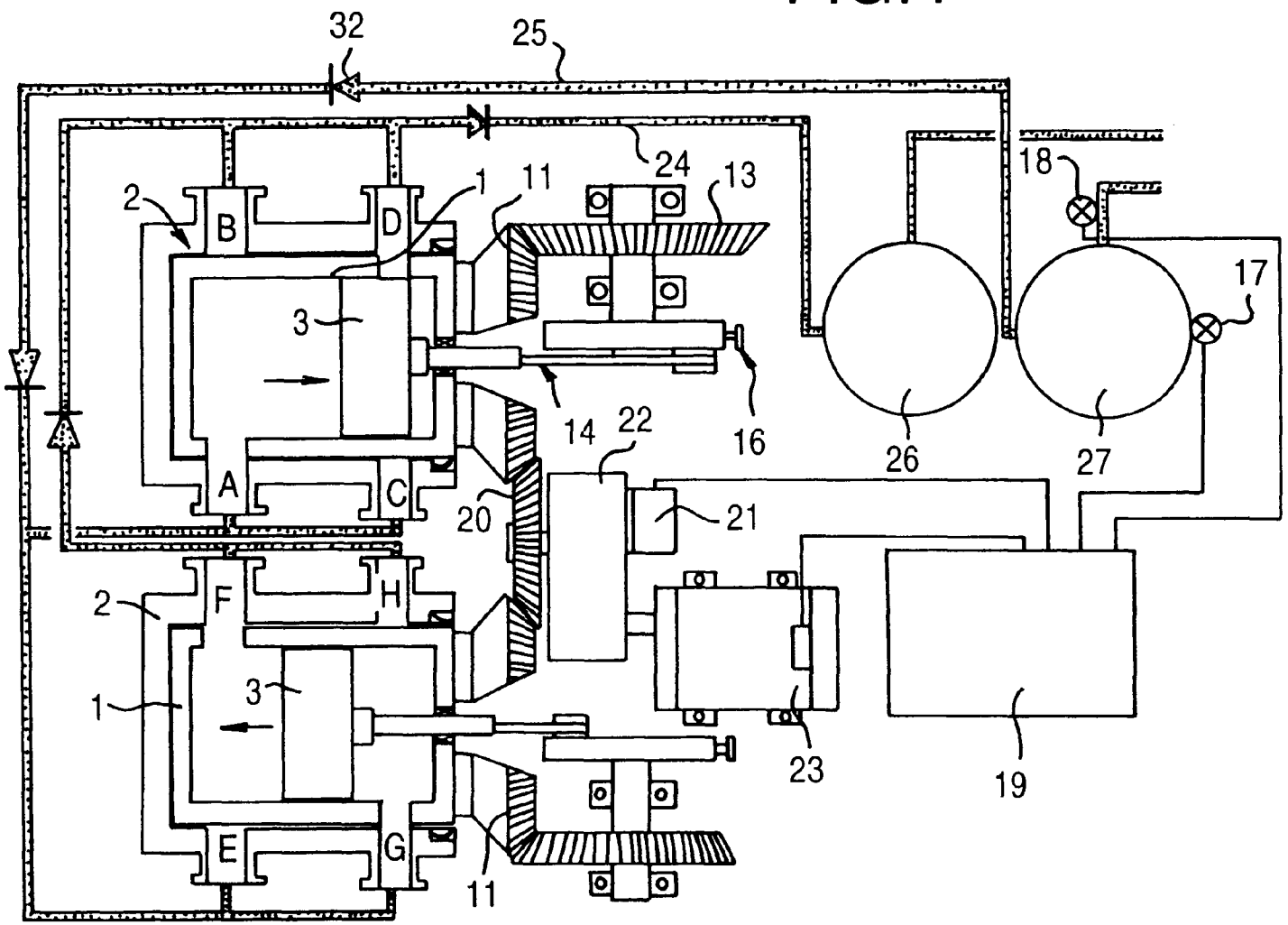
FIG. 4 is a sectional view showing a further embodiment of the present invention.

As shown in FIG. 4, pressure and or flow rate of fluid discharged from the through-hole communicated are (is) detected by a discharge pressure detection pipe 17 and or a flow rate detector 18, and the rotational speed of a reduction gear 22 is controlled through an automatic conversion mechanism 21 by a control device (a cascade control device) 19 on the basis of a signal detected, or the rotational speed of the reduction gear 22 is controlled through a motor 23 with rotation control to control the rotational speed of the inner tube 1 and the reciprocating speed of the cylinder 3 so as to suck and discharge the fluid having a predetermined pressure.

As shown in FIG. 1, even only one suction chamber (discharge chamber) of fluid, the fluid can be sucked continuously, and the fluid can be discharged continuously, the pulsation also being able to be prevented.

Figure 2:
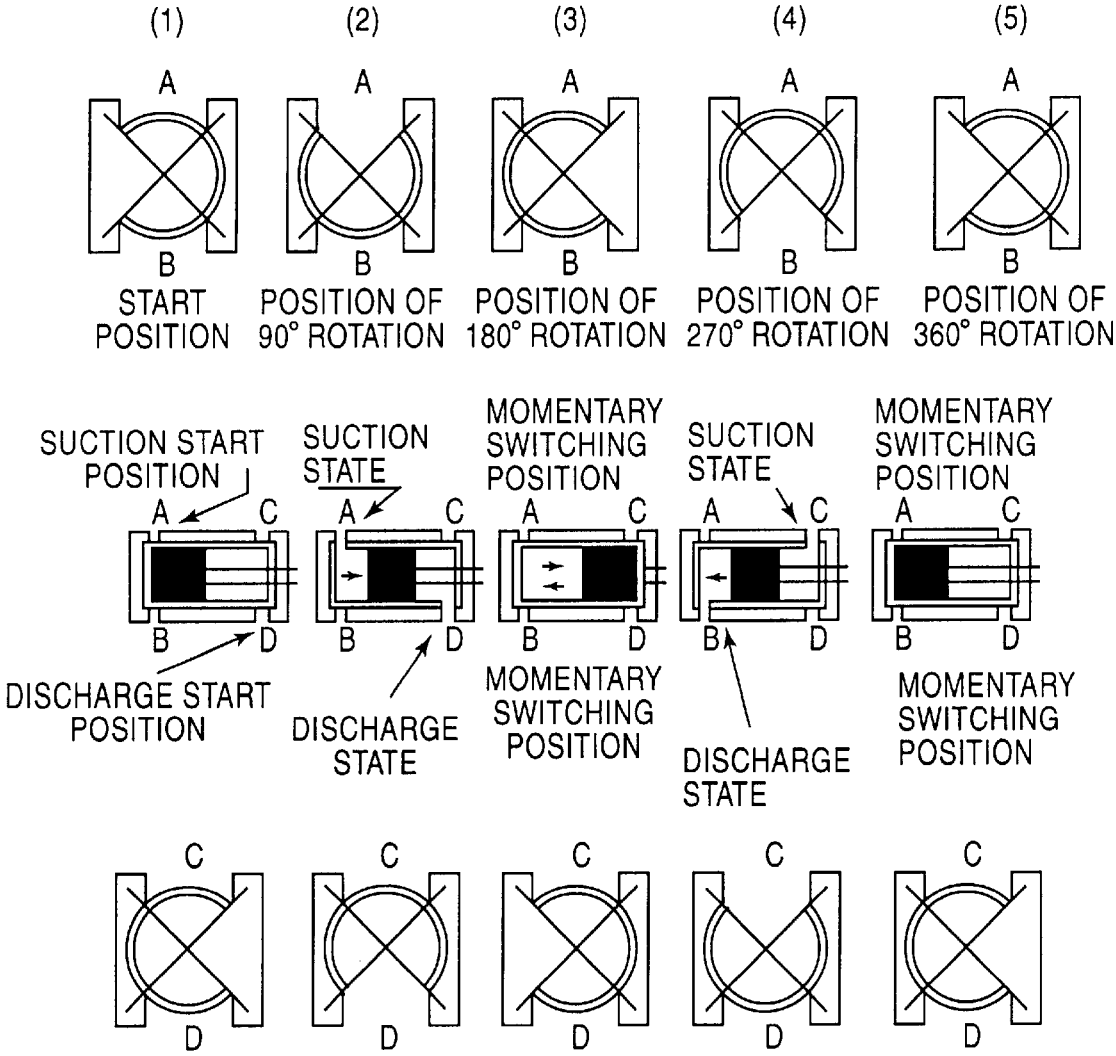
FIG. 2 is a sectional view showing an opening and closing state of a rotary valve of the present invention.

FIG. 2 shows the opening and closing state of the suction holes A, C and the discharge holes B, D of FIG. 1. The figure shows an example in which the suction holes A, C and the discharge holes B, D, and the through-holes 7, 8 of the inner tube are formed with a slot at 90° in the rotational direction., As shown in FIG. 2 (1), the start position is, in the figure, a position where the piston is pushed to the extreme end, and the suction holes A, C and the discharge holes B, D are closed. This shows that the suction hole A is in the suction start, and the discharge hole D is in the discharge start.

When the inner tube is rotated by 90°, the suction hole A is completely communicated with the through-hole 8 of the inner tube, and the discharge hole D is completely communicated with the through-hole 7 of the inner tube, as shown in FIG. 2 (2).

When the inner tube is further rotated by 90° (position of 180° rotation), there assumes the position where the piston is pulled to the rear end, and the position where the suction hole and discharge hole are momentarily switched, as shown in FIG. 2 (3). The suction holes A, C and the discharge holes B, D are closed. This shows that the suction hole C is in the suction start, and the discharge hole B is in the discharge start.

When the inner tube is further rotated by 90° (position of 270° rotation), the suction hole C is completely communicated with the though hole 7 of the inner tube, and the discharge hole B is completely communicated with the though hole 8 of the inner tube, as shown in FIG. 2 (4).

When the inner tube is further rotated by 90° (position of 360° rotation),the inner tube is returned to the initial start position, as shown in FIG. 2 (5). That is, it assumes the position where the piston is pushed to the extreme end, and assumes the momentarily switching position of the suction hole and the discharge hole. In this state, the suction holes A, C and the discharge holes B, D are closed. This shows that the discharge hole A is in the suction start, and the discharge hole D is in the discharge start.

Figure 3:
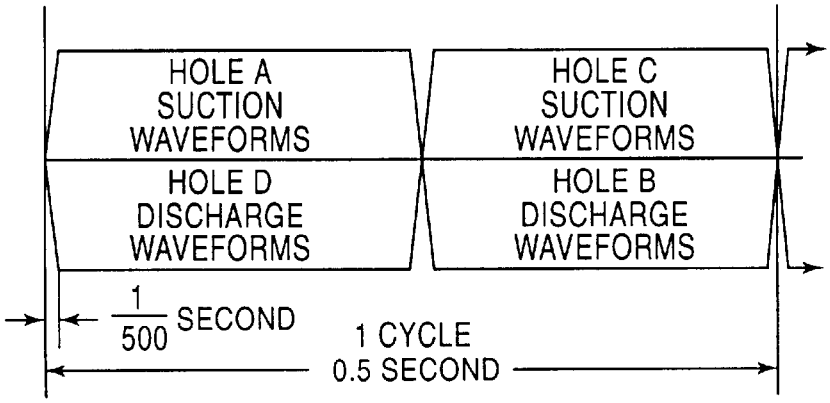
FIG. 3 is an explanatory view showing suction-discharge waveforms using the rotary valve of the present invention.

FIG. 3 shows the waveforms of the fluid quantity in which the fluid sucks and discharges from the suction holes A, C and the discharge holes B, D. It is understood from FIG. 3 that a predetermined quantity of fluids are sucked and discharged at the position other than the momentarily switching position. This is because even if the sizes of the suction hole and the discharge hole are different, a predetermined quantity of fluids are sucked and discharged, since the moving speed of the piston is constant. When 1 cycle is 0.5 second, a predetermined quantity of fluids are substantially to be sucked and discharged, since the switching position is about (1/500)×2 seconds, and it has been confirmed from experiments that no substantial pulsation occurs.

FIG. 4 shows an example in which a plurality of chambers in which the cylinder takes reciprocating motion are provided, and rotation is made with the switching position of the communication hole for suction and discharge of one chamber and the switching position of the communication hole for suction and discharge of the other chamber deviated.

That is, in the upper device (a first piston block), the suction hole A is opened and C is closed; and the discharge hole D is opened and B is closed. Accordingly, in this state, fluid is sucked from A, and fluid is discharged from D.

In this state, in the lower device (a second piston block), the suction hole G is opened and E is closed; and the discharge hole F is opened and H is closed. Accordingly, in this state, fluid is sucked from G, and fluid is discharged from F. Since both bevel gears 11, 11 are meshed with the bevel gear 20 and rotated, the first piston block and the second piston block are rotated reversibly to each other.

Accordingly, the first piston block and the second piston block are rotated reversibly in the state shown in FIG. 4.

Thereby, when one device is at a switching position, the other device is not at a switching position. Further, the switching position of the suction and discharge communication holes are not at a position that the piston is completely pushed and pulled, as in the embodiment of FIG. 2.

When two devices of the present invention are used as described above, the waveform of FIG. 3 is substantially constant, and pulsation can be almost completely eliminated. In FIG. 4, numeral 27 designates a chamber stabilized supply device; 26 a chamber pulsation preventing device; and 32 a check valve. The chamber stabilized supply device is provided whereby the suction inputting of fluid can be carried out in a stabilized manner, and the chamber pulsation preventing device is provided whereby the discharge supply of fluid can be carried out in a stabilized manner, which are however not always necessary.

Figure 5:
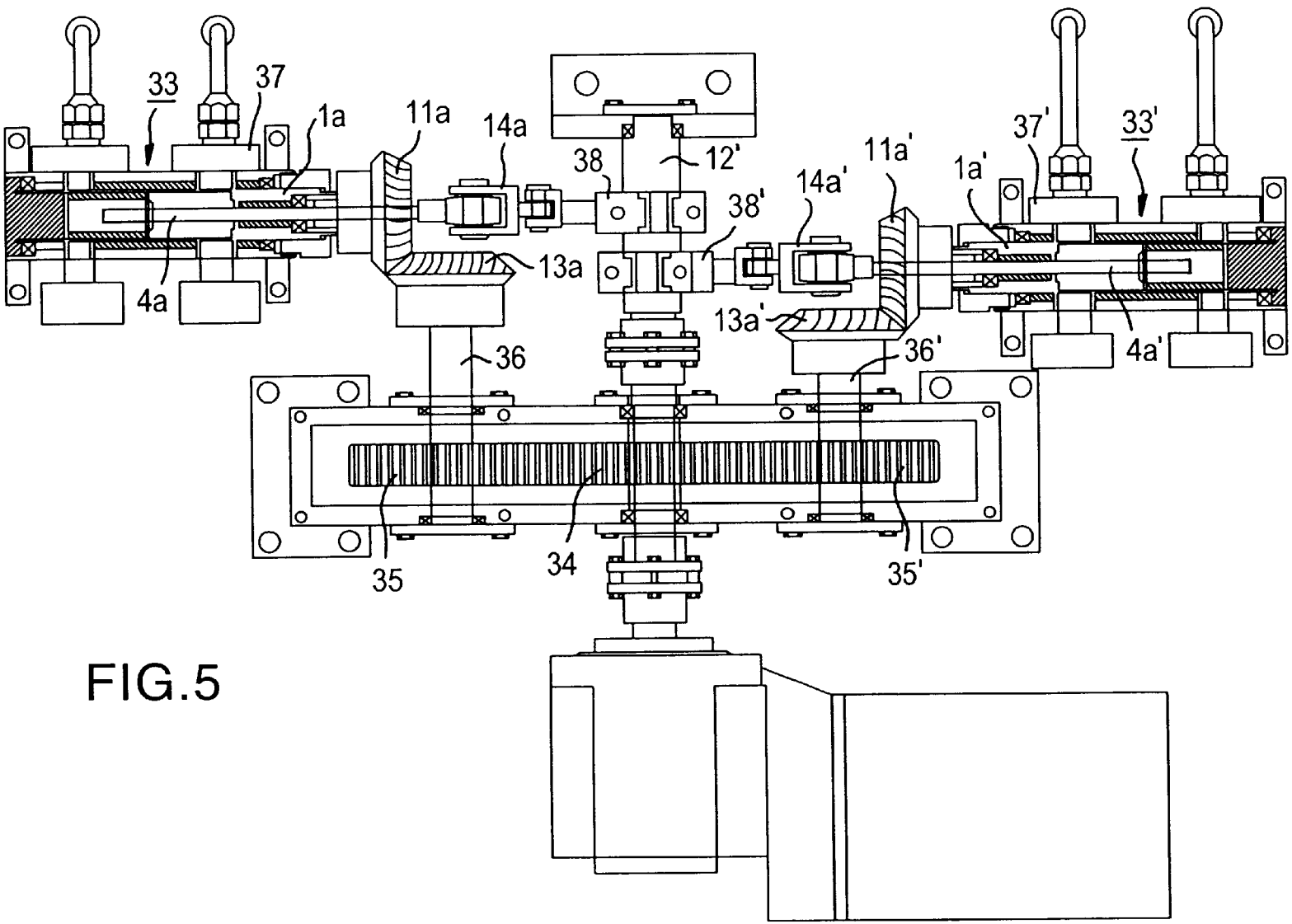
FIG. 5 is a sectional view showing another embodiment of the present invention.

FIG. 5 shows another embodiment of the present invention, which is a device in which two kinds of fluids are measured by separate suction and discharge devices 33, 33' of the present invention, which are mixed every predetermined quantity. This shows the case, for example, of a proportional injection pump used. For example, drugs in a predetermined compound are injected in order to remove silica adhered into the piping of the plant for producing vapor, but the proportional injection pump is used for the purpose of compounding the drugs. In this case, the suction and discharge devices of the present invention are required in the number of drugs to be compounded, but if the constitution as shown in FIG. 5 is employed, three or four or even more devices can be easily disposed.

When gears 35, 35' meshed with a gear 34 fitted in and secured to a rotational shaft (a drive shaft) 12' connected to the motor are rotated, bevel gears 13*a*, 13*a'* secured to rotational shafts 36, 36' of the gears 35, 35' rotate, bevel gears 11*a*, 11*a'* meshed at right angles to the bevel gears 13*a*, 13*a'* rotate, and inner tubes 1*a*, 1*a'* connected to the bevel gears 11*a*, 11*a'* rotate. Crankshafts 14*a*, 14*a'* are connected to tubes 38, 38' secured to a rotational shaft 12' so as to reciprocate piston rods 4*a*, 4*a'* connected to the crankshafts 14*a*, 14*a'*. In the figure, numerals 37, 37' designate filters, which filtrate fluid to be sucked.

In the above-described embodiments, since the tooth number of the gear 34, the gears 35, 35', the bevel gears 13*a*, 13*a'* and the bevel gears 11*a*, 11*a'* are all the same, when the rotational shaft 12' is rotated once, the inner tubes 1*a*, 1*a'* rotate once, and the piston rods 4*a*, 4*a'* reciprocate once.

Figure 6:
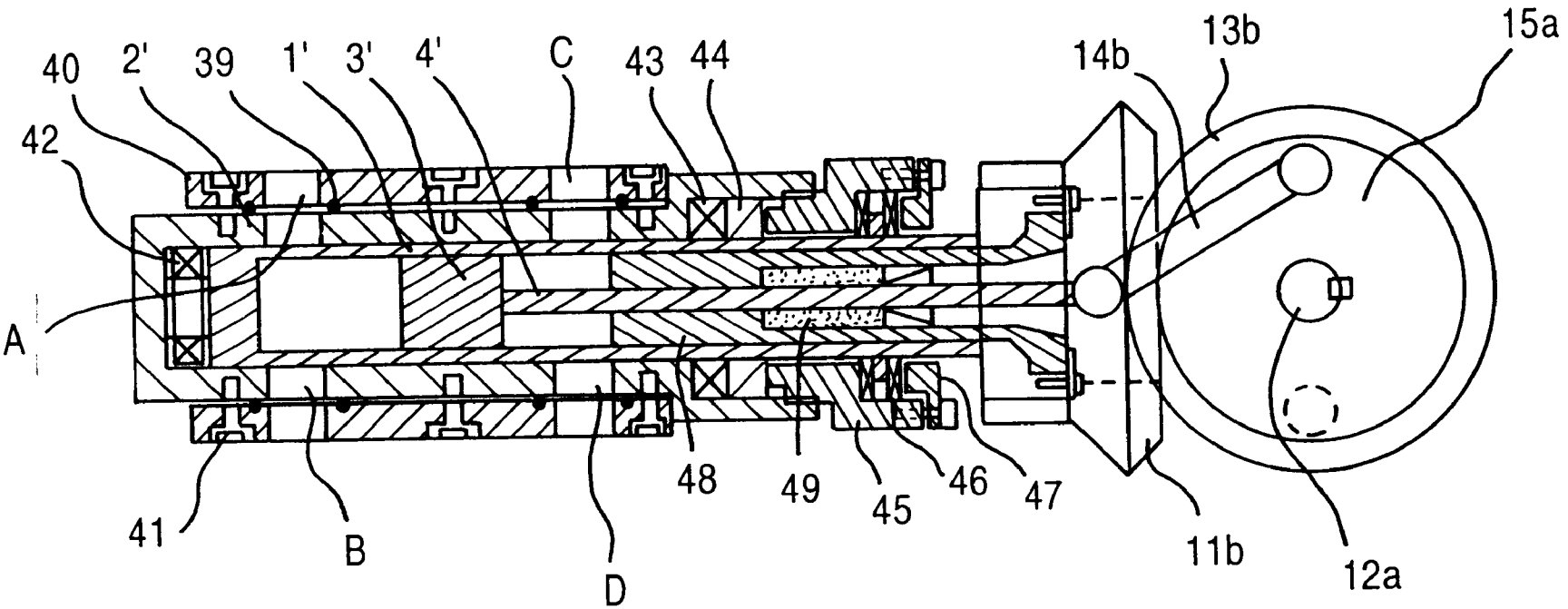
FIG. 6 is a sectional view showing still another embodiment of the present invention.

FIG. 6 shows another embodiment of the suction and discharge apparatus, in which a tubular flange member 40 is fitted in and secured to an outer tube (a pump body) 2' through an O-ring 39. The tubular flange member 40 is formed with a threaded hole 41, and a screw is threadedly engaged with the threaded hole to lock the outer tube 2'. In the figure, A and C designate suction holes, and B and D designate discharge holes. A suction hole and a discharge hole of the tubular flange member 40 are formed in the threaded hole, and a piping is threadedly connected to the threaded hole.

The inner tube 1' is rotatably fitted over the outer tube 2', and the extreme end of the inner tube comes in contact with the extreme end of the outer tube 2' through a bearing 42. The rear end of the outer tube is formed into a large diameter tube, a bearing 43 and an oil seal 44 are interposed between the large diameter tube and the inner tube 1, and a rotary valve oil seal keep metal fittings 45 is fitted in and secured to the rear end of the large diameter tube.

A rotary valve keep metal fittings 47 is fitted in and secured between the large diameter tube at the rear end of the rotary valve oil seal and inner tube 1' keep metal fittings 45 and inner tube 1' through a bearing 46.

A cylinder 3' is slidably fitted in the inner tube 1', and a piston shaft 4' connected to the cylinder 3' is slidably fitted in a fitting hole of a seal member 48 fitted in the inner tube 1'. The rear end of the seal member 48 is formed into a depressed part, and a seal material 49 is fitted in and secured between the depressed part and the piston shaft 4'.

The rear end of the piston shaft 4' is secured to a rotary body 15*a* secured to the rotary shaft 12*a* of the motor through a crankshaft 14*b*. A spiral miter bevel gear 11*b* is secured to the rear end of the inner tube 1', and the spiral miter bevel gear 11*b* is meshed at right angle with a spiral miter bevel gear 13*b* secured to the rotational shaft 12*a*.

For the seal member 48 and the seal material 49, a metal seal material containing, for example, aluminum and carbon or aluminum, carbon and silicon can be used. A suitable seal material free from leakage may be selected in accordance with the kind of fluids used.

Figure 7:
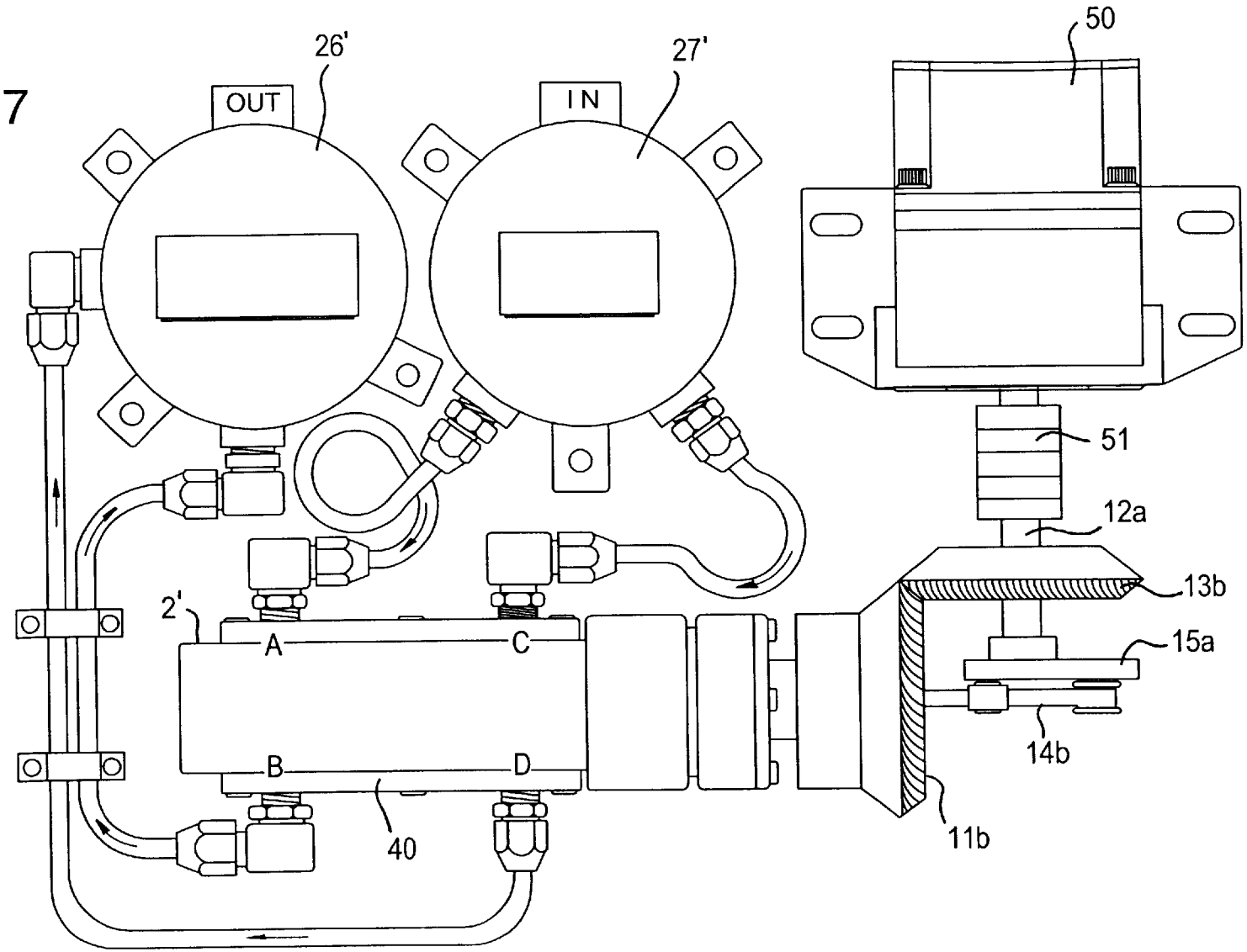
FIG. 7 is a side view showing another embodiment of the present invention.

FIG. 7 shows the embodiment of the suction and discharge apparatus of the present invention in case of being used as a pump for a fuel battery. A tubular flange member 40 is fitted in and secured to the outer tube 2', a volume chamber (a pressure vessel) 27' is connected to the suction inlets A, C of fluid, and a volume chamber (a pressure vessel) 26' is connected to the discharge outlets B, D of fluid through piping. The volume chamber is not always necessary, but by forming so, fluid can be always sucked (input) stably, and fluid can be always discharged (supplied).

Except that the driving shaft 12*a* of a motor 50 is connected through a universal joint 51, the bevel gears 11*b* and 13*b* are meshed, and the piston shaft is connected to the rotary body 15*a* connected to the driving shaft through the crankshaft 14*b*, similarly to FIG. 6.

Figure 8:
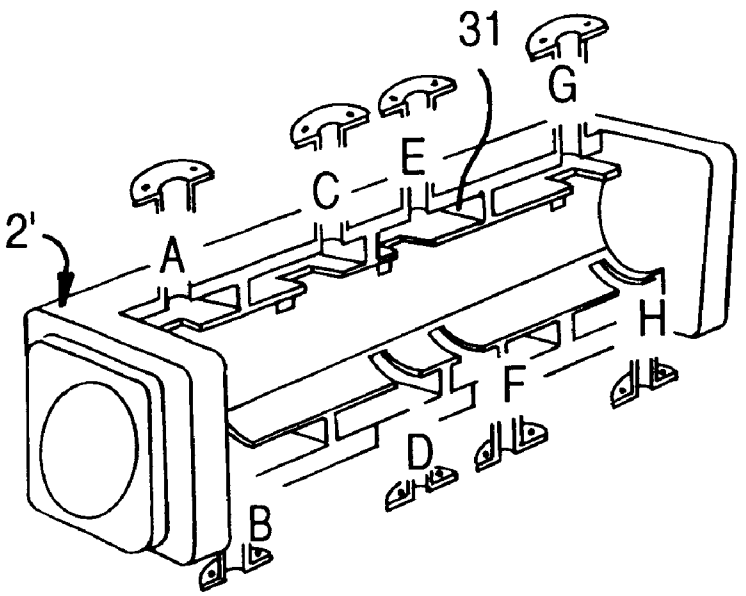
FIG. 8 is a partly cutaway perspective view showing another embodiment of the present invention.
Figure 8:
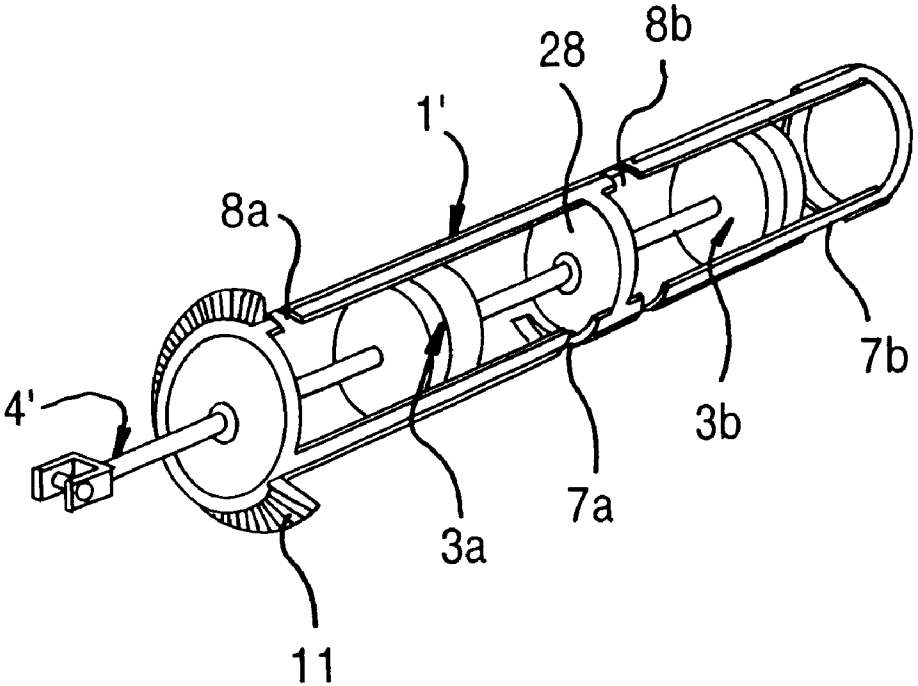

FIG. 8 shows still another embodiment of the present invention, in which the inner tube 1' can be rotatably fitted over the outer tube 2'. A first cylinder 3*a* and a second cylinder 3*b* are slidably fitted into the inner tube 1' through a partitioning wall 28 in the central part. Both the cylinders 3*a*, 3*b* are connected by the piston shaft 4' slidably fitted in the partitioning wall 28.

The cylinder housing chambers of the inner tube 1' are formed with through-holes 7*a*, 8*a* and 7*b*, 8*b* of slots in the rotational direction. The outer tube Z is formed with suction holes A, C, E, G and discharge holes B, D, F, H, and if the through holes are communicated with the suction holes, similarly to the previous embodiment, fluid is sucked, and if being communicated with the discharge holes, fluid is discharged.

Both the through-holes 7*a*, 7*b* and 8*a*, 8*b* are formed to be somewhat deviated in the rotational direction. Accordingly, the switching position can be deviated similarly to the embodiment of FIG. 4, and therefore, pulsation of exhaust can be completely eliminated.

An inner tube communication part between the suction holes A, C, E, G and the discharge holes B, D, F, H is formed in the volume chamber 31. This plays a part of regulating pressure, and in case of being used as a compressor, it plays a part of a receiver tank.

The size of the slot formed in the inner tube of the present invention is 60° to 180°, preferably, about 60° to 180°.

In the apparatus of the present invention, the pump mechanism does not use a check valve but is of a piston system, and therefore, the suction can be carried out positively, and the same quantity as the suction quantity can be discharged positively, thus not occurring pulsation and being free from loss of energy and being high accuracy. Accordingly, the function of the vacuum pump is very high in performance as compared with prior art.

Further, since the principle of mechanically pressing by a piston exerts on the discharge pressure, high pressure results, thus capable of being also used as a compressor. The apparatus of the present invention has achieved, first, that the roles of a vacuum pump and a compressor can be played by a single apparatus.

In the apparatus of the present invention, fluid can be discharged quickly or slowly by changing the rotational frequency, and the pressure of the discharge fluid as well as the flow rate can be made constant.

The apparatus of the present invention can be utilized as a vacuum pump, as a high pressure pump, as a constant quantity transfer pump, and as a compressor. The apparatus capable of being utilized for the multi-purpose as described has not at all been proposed heretofore.

If the pump of the present invention is used as a high pressure washing pump, washing can be done simply, due to the higher pressure than prior art, and it can be provided at less price. Further, if being used as a well pump, it can be utilized as a deep well pump due to the high vacuum degree.

Further, if the pump of the present invention is utilized as a fire fighting pump, a pump for water for industrial use, and a fountain pump, water is moved up to a higher position than the conventional pump because high pressure is used. Further, if being used as a hydraulic pump, the performance is higher than that of the conventional pump, and it can be provided at less price.

Advantageous Effect of the Invention

According to the present invention, since suction can be carried out continuously and discharge can be carried out continuously under the predetermined flow rate and pressure, occurrence of pulsation can be avoided, and the present invention exhibits materially conspicuous effect that can be used as a vacuum pump, as a high pressure pump, and as a compressor, which effect has not at all achieved by the conventional suction and discharge apparatus of this kind.

The entire disclosure of Japanese Patent Application No.66295 filed on Mar. 9, 2001, including specification, claims, drawings and summary are incorporated herein by reference in its entirety.

What is claimed is:

1. A suction and discharge apparatus comprising an inner tube rotatably fitted in a fitting hole of an apparatus body, a cylinder slidably fitted into the inner tube, and a plurality of through-holes formed in the inner tube, wherein when the cylinder is reciprocated in association with rotation of the inner tube, and when one of the through-holes of the inner tube is communicated with a suction hole of the apparatus body, the other through-hole of the inner tube is communicated with a discharge hole of the apparatus body, and when fluid is sucked from a communication suction hole thus communicated, fluid is discharged from the discharge hole thus communicated.

2. The apparatus according to claim 1 wherein said apparatus body is an outer tube or a block body having a fitting hole.

3. The apparatus according to claim 1 wherein the through-holes of said inner tube are formed in the surface opposite to each other and in both sides lengthwise of a position away in the sliding direction of the cylinder.

4. The apparatus according to claim 3 wherein the through-holes of said inner tube are formed into a long slot in the rotational direction.

5. The apparatus according to claim 4 wherein the slot of said inner tube is formed into a slot of approximately 60° to 180°.

6. The apparatus according to claim 4 wherein the suction holes and the discharge holes of said apparatus body capable of being communicated with the through-holes of said inner tube are formed in plural sets, one set being an opposed position.

7. The apparatus according to claim 6 wherein a plurality of chambers in which said cylinder is reciprocated, and a plurality of inner tubes are rotated so that a switching position of a communication hole for suction and discharge of one chamber is deviated from a switching position of a communication hole for suction and discharge of the other chamber whereby the total fluid quantity sucked and discharged from the communication holes of both the chambers are substantially uniformed.

8. The apparatus according to claim 6 wherein a volume chamber capable of receiving gas having a predetermined volume is connected to a suction pipe and a discharge pipe connected to said suction hole and said discharge hole, respectively.

9. The apparatus according to claim 1 wherein pressure and or flow rate of fluid discharged from said through-hole communicated are detected, and rotational speed of said inner tube and reciprocating speed of said cylinder are controlled on the basis of a detected signal to suck and discharge the fluid having predetermined pressure or flow rate.

10. The apparatus according to claim 1 wherein the end of said inner tube is connected to or formed in a first gear, said first gear being meshed with a second gear secured to a rotational shaft of a motor, and a crankshaft for reciprocating a piston shaft of said cylinder is secured to the rotational shaft of said motor through a rotary body, and when said inner tube is rotated once, said piston shaft is reciprocated once.

11. The apparatus according to claim 1 wherein said suction and discharge apparatus of fluid is a vacuum pump, a high pressure pump, a constant quantity transfer pump or a compressor.

* * * * *